US009733605B2

(12) United States Patent
Matos et al.

(10) Patent No.: US 9,733,605 B2
(45) Date of Patent: Aug. 15, 2017

(54) DETERMINING AN AVAILABLE CAPACITY

(71) Applicant: HEWLETT-PACKARD DEVELOPMENT COMPANY, L.P., Houston, TX (US)

(72) Inventors: Emilo Lopez Matos, Sant Cugat del Valles (ES); Jose Ma. Montserrat Caldero, Sant Cugat del Valles (ES); Joan Sanjuan Mercadal, Sant Cugat del Valles (ES); Ricardo Sanchis Estruch, Sant Cugat del Valles (ES); David Chanclon Fernandez, Sant Cugat del Valles (ES); Gianni Cessel, Sant Cugat del Valles (ES); Xavier Alonso Becerro, Sant Cugat del Valles (ES); Ignacio de Olazabal Zugasti, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 13/628,655

(22) Filed: Sep. 27, 2012

(65) Prior Publication Data

US 2014/0084536 A1 Mar. 27, 2014

(51) Int. Cl.

| | |
|---|---|
| ***G03G 15/00*** | (2006.01) |
| ***B65H 31/02*** | (2006.01) |
| ***B65H 1/04*** | (2006.01) |
| ***B65H 7/02*** | (2006.01) |

(52) U.S. Cl.

CPC ..... *G03G 15/6502* (2013.01); *B65H 1/04* (2013.01); *B65H 7/02* (2013.01); *B65H 31/02* (2013.01); *B65H 2301/4212* (2013.01); *B65H 2511/152* (2013.01); *B65H 2511/182* (2013.01); *B65H 2511/30* (2013.01); *B65H 2511/416* (2013.01); *B65H 2515/10* (2013.01); *B65H 2553/21* (2013.01); *B65H 2553/412* (2013.01); *B65H 2553/416* (2013.01); *B65H 2801/06* (2013.01); *G03G 2215/00729* (2013.01)

(58) Field of Classification Search

USPC ..... 271/207, 176, 145

See application file for complete search history.

(56) References Cited

U.S. PATENT DOCUMENTS

| | | | | |
|---|---|---|---|---|
| 5,018,717 | A * | 5/1991 | Sadwick et al. | 271/207 |
| 5,823,529 | A * | 10/1998 | Mandel et al. | 271/296 |
| 5,960,230 | A | 9/1999 | Peter | |
| 6,176,480 | B1 | 1/2001 | Yonenuma et al. | |
| 6,408,147 | B1 | 6/2002 | Oshida | |
| 6,891,604 | B2 | 5/2005 | Todome | |
| 7,374,163 | B2 | 5/2008 | Cook et al. | |
| 7,690,643 | B2 * | 4/2010 | Imai | 271/152 |
| 7,976,018 | B2 | 7/2011 | Ueda | |
| 8,177,215 | B2 * | 5/2012 | Ohkawa | 270/58.11 |
| 8,342,501 | B2 * | 1/2013 | Yoshimura et al. | 271/9.02 |
| 8,371,577 | B2 * | 2/2013 | Schoenmakers | 271/176 |

(Continued)

OTHER PUBLICATIONS

"Printing System with Tray Selection Substitution".

*Primary Examiner* — Kaitlin Joerger

(74) *Attorney, Agent, or Firm* — HP Inc—Patent Department

(57) ABSTRACT

A sensor can sense a weight of items in an area. A sensor can sense a height of items in the area. An available capacity of the area can be determined based on the sensed weight and height.

13 Claims, 4 Drawing Sheets

(56) References Cited

U.S. PATENT DOCUMENTS

| | | | | |
|---|---|---|---|---|
| 8,382,097 | B2 * | 2/2013 | Chiba | 271/147 |
| 8,514,437 | B2 * | 8/2013 | Oh | 358/1.15 |
| 8,523,171 | B2 * | 9/2013 | Fujita et al. | 271/96 |
| 2007/0262511 | A1 * | 11/2007 | Ohshima et al. | 271/10.01 |
| 2009/0226230 | A1 * | 9/2009 | Ohkawa | 399/408 |
| 2010/0044949 | A1 | 2/2010 | Nakamura | |
| 2010/0225047 | A1 * | 9/2010 | Yoshimura et al. | 271/9.07 |
| 2011/0128569 | A1 * | 6/2011 | Oh | 358/1.15 |
| 2012/0104688 | A1 * | 5/2012 | Blair et al. | 271/167 |
| 2012/0146282 | A1 * | 6/2012 | Chiba | 271/160 |
| 2012/0217697 | A1 * | 8/2012 | Schoenmakers | 271/207 |
| 2012/0299236 | A1 * | 11/2012 | Fujita et al. | 271/96 |

* cited by examiner

DETERMINING AN AVAILABLE CAPACITY

BACKGROUND

Printers come in various forms, shapes, configurations, and sizes. A printer typically has a source area for storing printable material and a destination area for outputting the printable material. For example, the source area can be a source tray and the destination area can be a destination tray. The printable material can be sheets of paper. Some printers accommodate various types and sizes of printable material. For example, large-format printers are often capable of printing paper having different material compositions, sizes, thicknesses, and weights.

BRIEF DESCRIPTION OF DRAWINGS

The following detailed description refers to the drawings, wherein.

DETAILED DESCRIPTION

According to an example, a printer can include a tray capacity sensing system. The system can include a weight sensor to sense a weight of items in a tray, such as a destination tray of the printer. The weight sensor can include variable resistance sensors. The system can also include a height sensor to sense a height of items in the tray. The height sensor can include an LED emitter-receiver combination for creating a light barrier. A controller can determine an available capacity of the tray based on the sensed weight and height.

If the tray is a destination tray, the available capacity can indicate how much space is available to accommodate printable materials (e.g., sheets) from additional print jobs. Additionally, the controller can determine whether there is a defect, such as a sheet bubble, in the destination tray based on a misalignment between the sensed weight and height. A user can be notified via a user interface regarding the available capacity or the defect. Accordingly, a printing process can be made more efficient and a user experience can be improved since the destination tray need not be constantly monitored. Further details of this example and associated advantages, as well as of other examples, will be discussed in more detail below with reference to the drawings.

Figure 1:
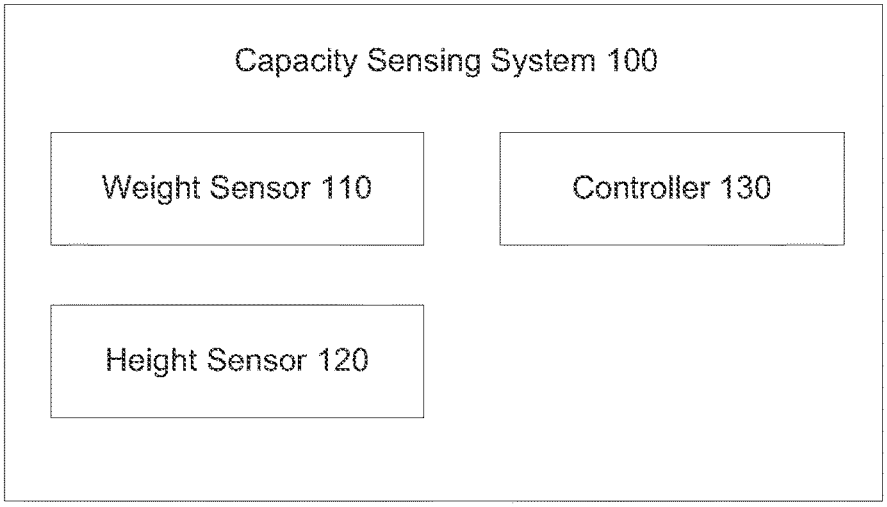
FIG. 1 illustrates a tray capacity sensing system, according to an example.

Referring now to the drawings, FIG. 1 illustrates a capacity sensing system 100. Capacity sensing system 100 can be implemented in a tray of a printer. In the examples described below, the capacity sensing system and other examples are described in relation to a destination tray of a printer for determining an available capacity in the destination tray. However, in other examples, the capacity sensing system 100 can be implemented in a source tray of a printer for determining a remaining amount of printable materials in the source tray.

Capacity sensing system 100 can include a weight sensor 110. Weight sensor 110 can be configured to sense a weight of items in the destination tray of the printer. The items may be printable materials, such as sheets. The sheets may be comprised of various material compositions and may have various sizes, thicknesses, and weights.

Weight sensor 110 may include one or more sensors for sensing a weight of items. For example, weight sensor 110 may include one or more variable resistance sensors. The variable resistance sensors may be located at the bottom of the destination tray and may be configured to sense a pressure being exerted by items stacked on top of the sensors.

Capacity sensing system 100 can include a height sensor 120. The height sensor 120 can be configured to sense a height of items the destination tray. Various sensors for sensing or determining a height of stacked items may be used. For example, the height sensor may create an optical barrier along the height of the destination tray. The height of stacked sheets may be determined based on where the optical barrier is broken.

An example height sensor that creates an optical barrier may include an array of emitters to emit signals and array of receivers to receive the emitted signals. The array of emitters may include light emitting diodes (LEDs) for emitting infrared modulated light. Infrared light may be used due to its robustness against variant ambient light conditions. The light may be modulated to make it more robust against ambient temperature and possible external infrared interferences. The array of receivers may include photodetectors for receiving the infrared modulated light.

Capacity sensing system 100 can include a controller 130. Controller 130 can be configured to determine an available capacity of the destination tray based on the weight sensed by weights sensor 110 and the height sensed by height sensor 120. The available capacity can indicate an amount of space estimated to be available (e.g., free, empty) in the destination tray.

In some examples, a capacity of a destination tray may be limited by both a maximum weight and a maximum height. Thus, it can be useful to sense both a weight and height of items in the tray to determine whether either maximum is met or exceeded or is close to being met or exceeded. Moreover, especially in the case of a printer that accommodates multiple types, sizes, thicknesses, and weights of sheets, knowing only a weight or a height of the stacked sheets may not be sufficient for determining the other measurement.

Additionally, by considering both a sensed weight and sensed height of stacked sheets in a destination tray, defects may be discovered. For example, a potential defect in a printer destination tray may be that an air bubble forms under a portion of a sheet such that the portion of the sheet sticks up higher in the destination tray than the rest of the sheet. If only a height sensor was used and the portion of the sheet with the air bubble underneath broke the optical barrier, it might be erroneously determined that the destination tray was full or had less capacity than in reality. However, by considering both a sensed height and a sensed weight, a defect such as an air bubble may be detected based on a misalignment between the sensed height and the sensed weight. Additional details for detecting a defect such as this are described later with respect to FIG. 5.

A controller, such as controller 130, may include a processor and a memory for implementing machine readable instructions. The processor may include at least one central processing unit (CPU), at least one semiconductor-based microprocessor, at least one digital signal processor (DSP) such as a digital image processing unit, other hardware devices or processing elements suitable to retrieve and execute instructions stored in memory, or combinations thereof. The processor can include single or multiple cores on a chip, multiple cores across multiple chips, multiple cores across multiple devices, or combinations thereof. The processor may fetch, decode, and execute instructions from memory to perform various functions. As an alternative or in addition to retrieving and executing instructions, the processor may include at least one integrated circuit (IC), other control logic, other electronic circuits, or combinations thereof that include a number of electronic components for performing various tasks or functions.

The controller may include memory, such as a machine-readable storage medium. The machine-readable storage medium may be any electronic, magnetic, optical, or other physical storage device that contains or stores executable instructions. Thus, the machine-readable storage medium may comprise, for example, various Random Access Memory (RAM), Read Only Memory (ROM), flash memory, and combinations thereof. For example, the machine-readable medium may include a Non-Volatile Random Access Memory (NVRAM), an Electrically Erasable Programmable Read-Only Memory (EEPROM), a storage drive, a NAND flash memory, and the like. Further, the machine-readable storage medium can be computer-readable and non-transitory. Additionally, capacity sensing system 100 may include one or more machine-readable storage media separate from the one or more controllers.

Figure 2:
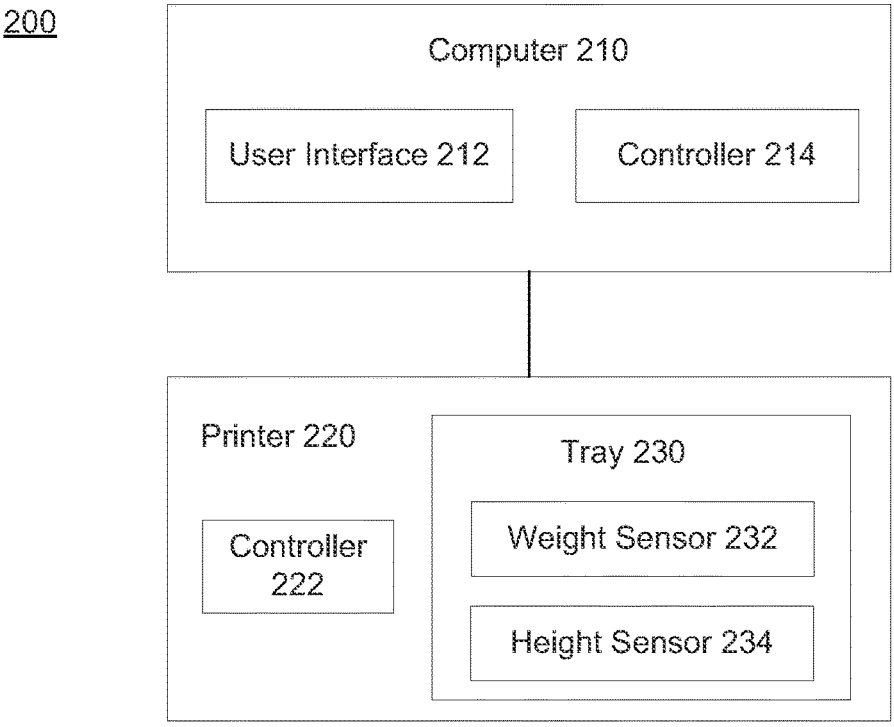
FIG. 2 illustrates a system for determining an available capacity in a printer tray, according to an example.

FIG. 2 illustrates a system 200 for determining an available capacity in a printer tray, according to an example. System 200 can include a computer 210 and a printer 220. Computer 210 may be any of various computers, such as a desktop computer, a workstation computer, a server computer, a tablet or slate computer, a smart phone, or the like. Printer 220 may be any of various printers, such as an inkjet printer, a laser printer, or a large-format printer. In some examples, computer 210 can be integrated with printer 220.

Figure 3:
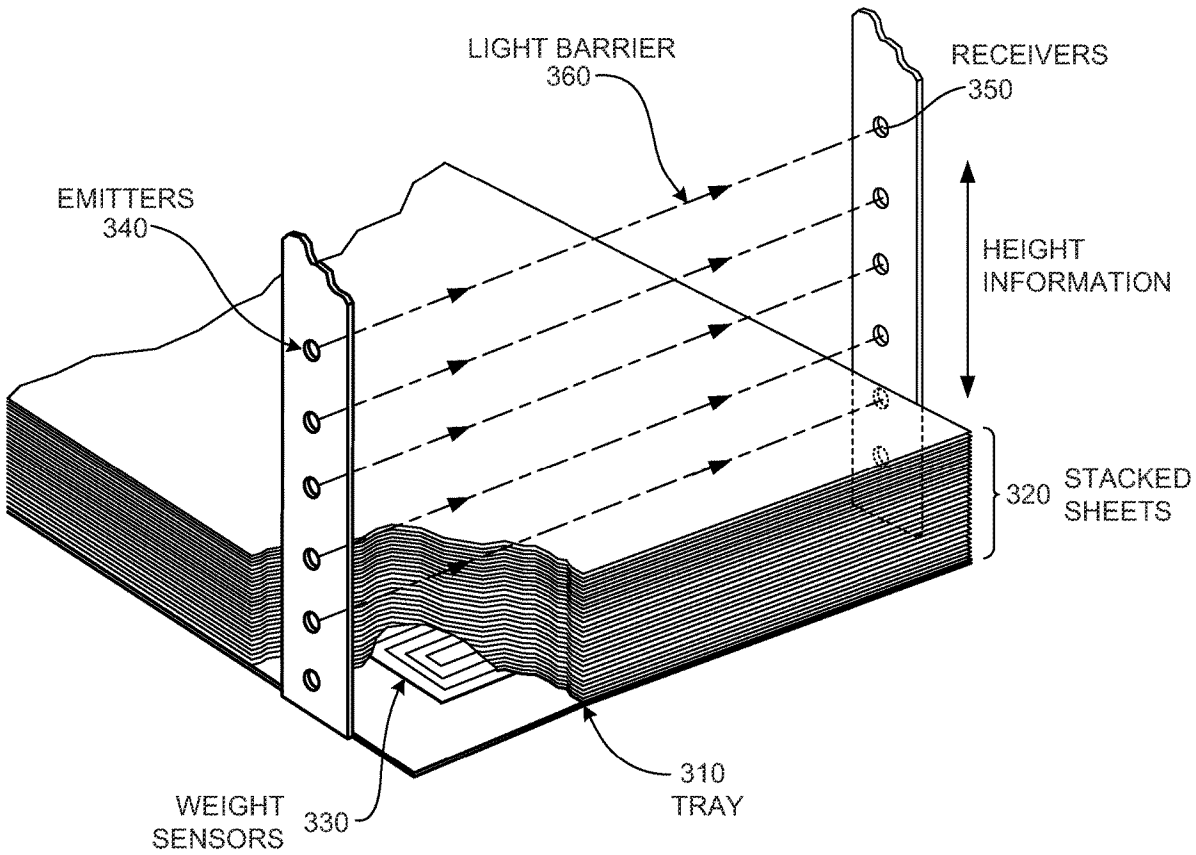
FIG. 3 illustrates a printer tray with a weight sensor and a height sensor, according to an example.

Computer 210 may include a user interface 212 and a controller 214. Printer 220 may include a controller 222 and a tray 230 with a weight sensor 232 and height sensor 234. Tray 230 may be a destination tray of printer 220. Weight sensor 232 and height sensor 234 may be integrated into tray 230 (such as depicted in FIG. 3). Controller 222 or controller 214 may be configured to determine an available capacity of tray 230 based on measurements from weight sensor 232 and height sensor 234, as described herein.

User interface 212 may be configured to provide an alert to a user regarding an available capacity of tray 230 or regarding a defect, such as a paper bubble, in tray 230. User interface 212 may include input devices, such as a keyboard, a mouse, and a microphone, and output devices, such as a display and a speaker. Additionally, user interface 212 may include a graphical user interface implemented by a software module for receiving input from a user and providing output to the user.

Based on the determined available capacity, a user may be notified whether there is sufficient room in the destination tray to accommodate a print job requested by the user. For instance, controller 214 or 222 may calculate a weight and height of sheets expected to be output for a print job based on characteristics of the print job (e.g., the number of pages, the number of copies, the type of paper selected, etc.). This calculated weight and height may be compared to the available capacity of the tray to determine whether the tray can accommodate the print job.

Additionally, if a defect is detected, the user may take appropriate action to correct the defect before proceeding with a print job. Thus, the integrity of the print jobs in the destination tray may be preserved by eliminating the defect so that sheets aren't later bent, folded, or crushed. Additionally, after correcting the defect, the height and weight of sheets in the tray may be sensed again to determine a more accurate available capacity.

FIG. 3 illustrates a printer tray with a weight sensor and a height sensor, according to an example. Tray 310 may correspond to tray 230 in FIG. 2, for example, and may be a destination tray. Tray 230 can include multiple stacked sheets 320. The stacked sheets 320 may be made up of a number of previously printed print jobs. The tray 310 includes one or more weight sensors 330, which may be variable resistances sensors for detecting applied pressure. Tray 310 includes multiple emitters 340 and receivers 350 located along a vertical axis (e.g., height) of tray 310. Emitters 340 may generate a light barrier 360. When sheets 320 break part of the light barrier and prevent some of receivers 350 from receiving the signals emitted by emitters 340, the height of the stacked sheets may be determined based on which receivers 350 are still able to receive the signals emitted by emitters 340. Based on the detected height and weight information, an available capacity of tray 310 may be determined.

Figure 4:
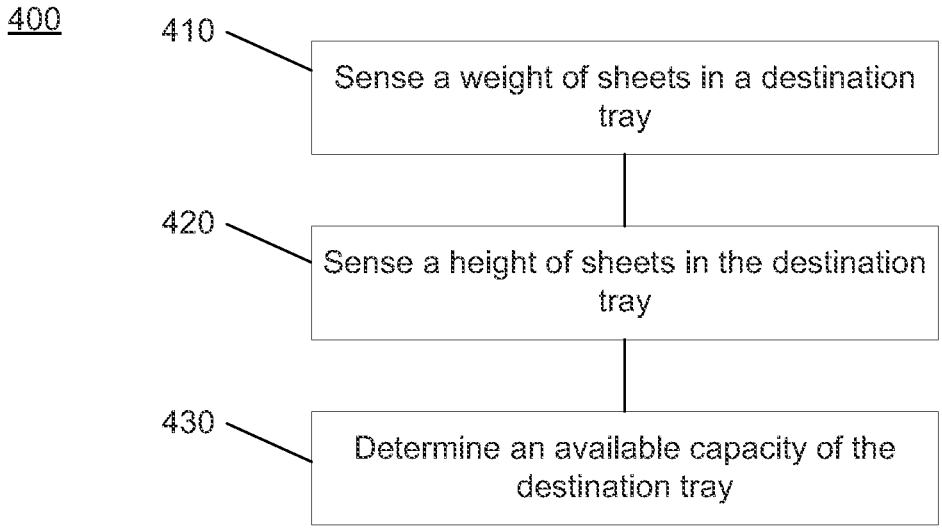
FIG. 4 illustrates a method of determining an available capacity of a destination tray, according to an example.

FIG. 4 illustrates a method of determining an available capacity of a destination tray, according to an example. Method 400 may be implemented by a system, such as system 100 or 200. At 410, a weight of sheets in a destination tray may be sensed using a first sensor. The first sensor may correspond to weight sensor 110 or 232. At 420, a height of sheets in the destination tray may be sensed by a second sensor. The second sensor may correspond to height sensor 120 or 234. At 430, an available capacity of the destination tray may be determined based on the sensed weight and sensed height. The available capacity may be determined by an appropriately programmed controller, such as controller 130, 214, or 222.

Figure 5:
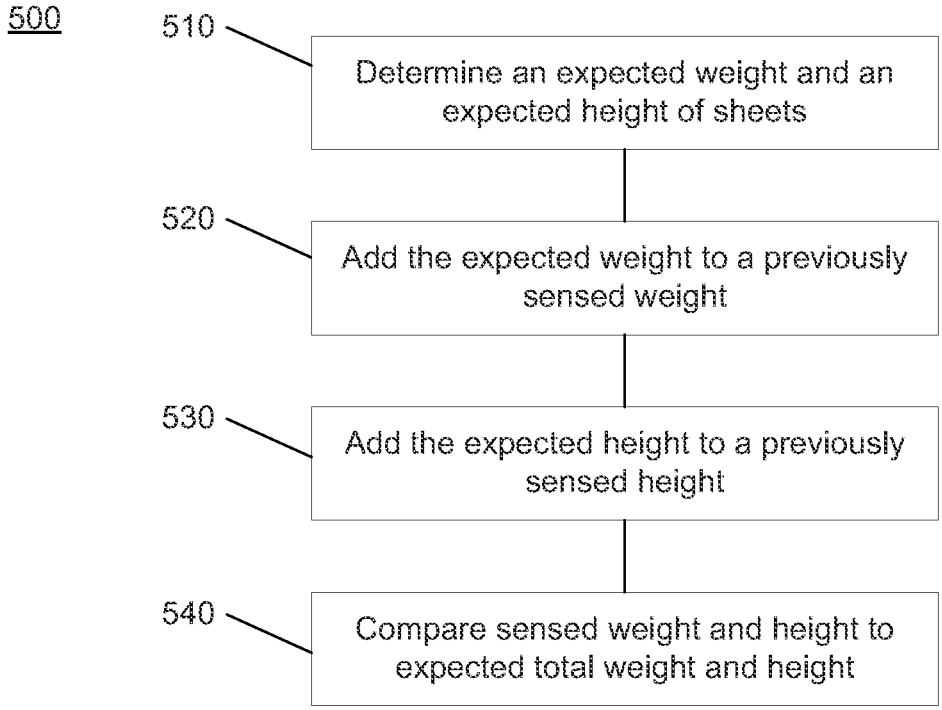
FIG. 5 illustrates a method of determining whether there is a defect in a detected available capacity, according to an example.

Additionally, it may be determined whether there is a defect in the destination tray and/or in a detected available capacity based on the sensed weight and the sensed height. The defect may be a bubble in the sheets or a sheet jam. FIG. 5 illustrates a method of determining whether there is a defect in a detected available capacity, according to an example. Method 500 may be implemented by a system, such as system 100 or 200.

At 510, an expected weight and an expected height of sheets associated with a most recent print job may be determined. The most recent print job is the print job that was last printed to the destination tray. The expected weight and expected height associated with that print job may be the total expected weight and height of sheets that were to be printed with the print job. This information may be maintained in a job history associated with a print controller, for example.

At 520, the expected weight may be added to a previously sensed weight of sheets in the destination tray to yield an expected total weight. The previously sensed weight is the weight of sheets sensed by the weight controller before the most recent print job was executed. At 530, the expected height may be added to a previously sensed height of sheets in the destination tray to yield an expected total height. The previously sensed height is the height of sheets sensed by the height controller before the most recent print job was executed.

At 540, the sensed weight and sensed height may be compared to the calculated expected total weight and expected total height. The sensed weight and sensed height may be the currently sensed weight and height (which was sensed to determine the current available capacity). It may be determined that there is a defect based on a discrepancy between the sensed weight and expected total weight and/or between the sensed height and the expected total height. An amount of allowable discrepancy between these values may be set beforehand. For example, a discrepancy of 5% may be allowed without signaling a defect. Of course, other allowable discrepancies may be used, such as 1%, 10%, based on how sensitive one desires the defect feature to be.

In another example, a defect may be determined based on a misalignment between a detected weight and a detected height. For instance, maximum differences between a detected weight and height may be set in advance based on knowledge of the printing material used by the printer. Alternatively, a change in weight and height relative to a previously sensed weight and height may be determined, and the change in weight and height may be compared to each other. Similarly, maximum differences between a changed weight and height may be set in advance based on knowledge of the printing material used by the printer. In all of these examples, the information may be received or determined based on data from a print controller or stored in a memory of a printer or a computer supporting the printer.

Figure 6:
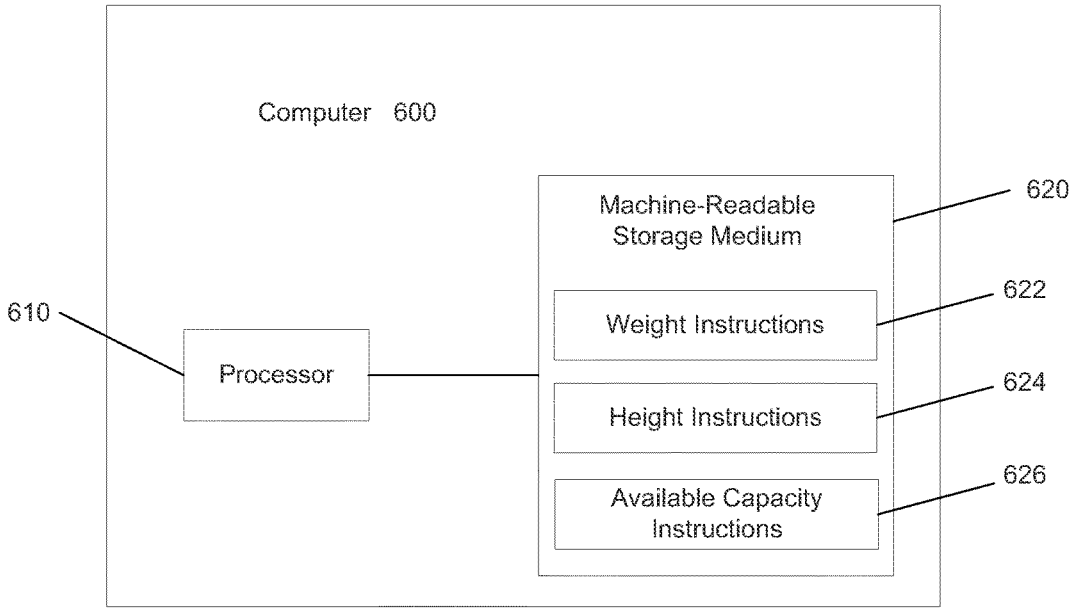
FIG. 6 illustrates a computer-readable medium for determining an available capacity, according to an example.

FIG. 6 illustrates a computer-readable medium for determining an available capacity, according to an example. Computer 600 may be any of a variety of computing devices, printers, or systems, as described above.

Processor 610 may be at least one central processing unit (CPU), at least one semiconductor-based microprocessor, other hardware devices or processing elements suitable to retrieve and execute instructions stored in machine-readable storage medium 620, or combinations thereof. Processor 610 can include single or multiple cores on a chip, multiple cores across multiple chips, multiple cores across multiple devices, or combinations thereof. Processor 610 may fetch, decode, and execute instructions 622, 624, 626, among others, to implement various processing. As an alternative or in addition to retrieving and executing instructions, processor 610 may include at least one integrated circuit (IC), other control logic, other electronic circuits, or combinations thereof that include a number of electronic components for performing the functionality of instructions 622, 624, 626. Accordingly, processor 610 may be implemented across multiple processing units and instructions 622, 624, 626 may be implemented by different processing units in different areas of computer 600.

Machine-readable storage medium 620 may be any electronic, magnetic, optical, or other physical storage device that contains or stores executable instructions. Thus, the machine-readable storage medium may comprise, for example, various Random Access Memory (RAM), Read Only Memory (ROM), flash memory, and combinations thereof. For example, the machine-readable medium may include a Non-Volatile Random Access Memory (NVRAM), an Electrically Erasable Programmable Read-Only Memory (EEPROM), a storage drive, a NAND flash memory, and the like. Further, the machine-readable storage medium 620 can be computer-readable and non-transitory. Machine-readable storage medium 620 may be encoded with a series of executable instructions for managing processing elements.

The instructions 622, 624, 626, when executed by processor 610 (e.g., via one processing element or multiple processing elements of the processor) can cause processor 610 to perform processes, for example, the processes depicted in FIGS. 4 and 5. Furthermore, computer 600 may be similar to systems 100 or 200 and may have similar functionality and be used in similar ways, as described above.

Weight instructions 622 can cause processor 610 to receive a weight of sheets in a destination area of a printer. The destination area may be a destination tray. The weight may be determined by a weight sensor. Height instructions 624 can cause processor 610 to receive a height of sheets in the destination area of the printer. The height may be determined by a height sensor. Available capacity instructions 626 can cause processor 610 to calculate an available capacity of the destination area based on the weight and height of sheets in the destination area. Additionally, it can be determined whether the available capacity of the destination area can accommodate an additional print job that includes a multiple sheets. It may also be determined whether there is an error at the destination area. The error may be indicative of a misalignment between the sensed weight and sensed height or between the sensed weight and height and an expected weight and height.

What is claimed is:

1. A system, comprising:

a weight sensor to sense a weight of items in an area;

a height sensor to sense a height of items in the area; and a controller to determine an available capacity of the area based on the sensed weight and height;

wherein the area is a source or destination tray of a printer and the items are sheets; and wherein the controller is configured to determine if there is a bubble in the sheets based on a misalignment between the sensed height and sensed weight.

2. The system of claim 1, further comprising a user interface to provide an alert regarding the available capacity to a user.

3. The system of claim 1, wherein the height sensor comprises an array of emitters to emit signals and an array of receivers to receive the emitted signals, wherein the signals form an optical barrier.

4. The system of claim 1, wherein the weight sensor comprises a variable resistance sensor.

5. A method comprising:

sensing a weight of sheets in a destination area using a first sensor;

sensing a height of the sheets in the destination area using a second sensor;

determining an available capacity of the destination area based on the sensed weight and sensed height; and determining whether there is a defect based on the sensed weight and the sensed height.

6. The method of claim 5, wherein the defect is a bubble in the sheets or a sheet jam.

7. The method of claim 5, wherein it is determined whether there is a defect by:

determining an expected weight and an expected height of sheets associated with a most recent print job;

adding the expected weight to a previously sensed weight to yield an expected total weight;

adding the expected height to a previously sensed height to yield an expected total height; and comparing the sensed weight to the expected total weight and the sensed height to the expected total height.

8. The method of claim 7, wherein the expected weight and the expected height of sheets associated with the most recent print job is determined based on data received from a print controller in a large format printer.

9. The method of claim 5, further comprising providing a notification to a user indicating whether the available capacity of the destination area is sufficient to accommodate a requested print job based on an expected weight and an expected height of sheets associated with the requested print job.

10. A non-transitory computer-readable storage medium comprising instructions that, when executed by a processor, cause the processor to:

receive a weight of sheets in a destination area of a printer;

receive a height of sheets in the destination area;

calculate an available capacity of the destination area based on the weight and height of sheets in the destination area; and determine whether there is a defect based on the weight and the height.

11. The computer-readable storage medium of claim 10, further comprising instructions to cause the processor to:

determine whether the available capacity of the destination area can accommodate an additional print job comprising a plurality of sheets.

12. The computer-readable storage medium of claim 10, further comprising instructions to cause the processor to:

detect whether there is an error at the destination area based on the weight and height of sheets in the destination area.

13. The computer-readable storage medium of claim 10, wherein the weight of sheets is received from a weight sensor and the height of sheets is received from a height sensor.

* * * * *